US009383667B2

(12) United States Patent
Takemori et al.

(10) Patent No.: US 9,383,667 B2
(45) Date of Patent: Jul. 5, 2016

(54) ELECTROSTATIC LATENT IMAGE DEVELOPING TONER

(71) Applicant: KYOCERA Document Solutions Inc., Osaka (JP)

(72) Inventors: Toshiki Takemori, Osaka (JP); Masashi Yamashita, Osaka (JP); Hiroki Uemura, Osaka (JP); Yukinori Nakayama, Osaka (JP); Masaki Okita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/496,323

(22) Filed: Sep. 25, 2014

(65) Prior Publication Data

US 2015/0086918 A1 Mar. 26, 2015

(30) Foreign Application Priority Data

Sep. 26, 2013 (JP) ..... 2013-200562

(51) Int. Cl.

| | |
|---|---|
| ***G03G 9/093*** | (2006.01) |
| ***G03G 9/08*** | (2006.01) |
| ***G03G 9/087*** | (2006.01) |

(52) U.S. Cl.

CPC ..... *G03G 9/0821* (2013.01); *G03G 9/08755* (2013.01); *G03G 9/08782* (2013.01); *G03G 9/08795* (2013.01); *G03G 9/08797* (2013.01); *G03G 9/09328* (2013.01); *G03G 9/09371* (2013.01); *G03G 9/09392* (2013.01)

(58) Field of Classification Search

CPC ..... G03G 9/08782; G03G 9/08755; G03G 9/08795; G03G 9/08797; G03G 9/09371

See application file for complete search history.

(56) References Cited

U.S. PATENT DOCUMENTS

| | | | | |
|---|---|---|---|---|
| 4,980,257 | A * | 12/1990 | Anno | G03G 9/0825 428/407 |
| 7,247,413 | B2 | 7/2007 | Kido et al. | |
| 2005/0074685 | A1 | 4/2005 | Kido et al. | |
| 2005/0271964 | A1 | 12/2005 | Etou et al. | |
| 2009/0245858 | A1 * | 10/2009 | Mizutani | G03G 9/0804 399/111 |
| 2013/0164669 | A1 * | 6/2013 | Yamashita | C08G 63/916 430/108.4 |

FOREIGN PATENT DOCUMENTS

| | | | |
|---|---|---|---|
| JP | 2002-311646 | A | 10/2002 |
| JP | 2004-138985 | A | 5/2004 |
| JP | 2005-099083 | A | 4/2005 |
| JP | 2007-121473 | A | 5/2007 |
| JP | 2007-148200 | A | 6/2007 |
| JP | 2008-096788 | A | 4/2008 |

* cited by examiner

*Primary Examiner* — Peter Vajda

(74) *Attorney, Agent, or Firm* — Studebaker & Brackett PC

(57) ABSTRACT

An electrostatic latent image developing toner includes toner particles. Each of the toner particles includes a toner core containing a binder resin and a releasing agent, and a shell layer coating the toner core. The releasing agent has a melting point Mp′ of no less than 50° C. and no greater than 100° C. The releasing agent has a number average dispersion diameter of no less than 30 nm and no greater than 500 nm. The shell layer is made from a resin including a unit derived from a monomer of a thermosetting resin. The thermosetting resin is one or more amino resins from among a melamine resin, a urea resin, and a glyoxal resin.

11 Claims, 1 Drawing Sheet

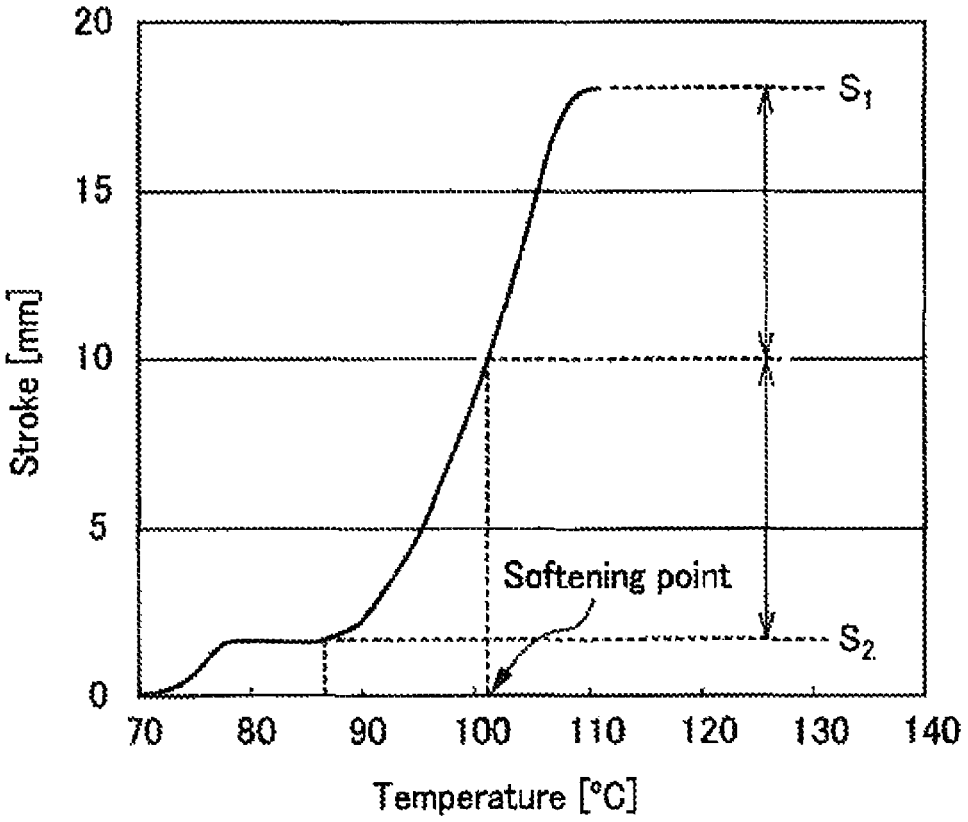
20
15
10
5
0
Stroke [mm]
70
80
90
100
110
120
130
140
Temperature [°C]
S1
S2
Softening point

ELECTROSTATIC LATENT IMAGE DEVELOPING TONER

INCORPORATION BY REFERENCE

The present application claims priority under 35 U.S.C. §119 to Japanese Patent Application No. 2013-200562, filed Sep. 26, 2013. The contents of this application are incorporated herein by reference in their entirety.

BACKGROUND

The present disclosure relates to an electrostatic latent image developing toner.

From a viewpoint of energy saving and apparatus miniaturization, a toner should preferably have excellent low-temperature fixability such as to be favorably fixable with minimal heating of a fixing roller. In order to produce a toner having excellent low-temperature fixability, it is common to use a binder resin having a low melting point or glass transition point, and a releasing agent having a low melting point. Therefore, when such a toner is stored at high temperatures, a problem occurs of toner particles in the toner having a high tendency to aggregate. Aggregated toner particles tend to have a reduced electrostatic charge compared to other toner particles that are not aggregated.

In order to achieve objectives of excellent fixability even at low temperatures, improved preservability at high temperatures, and improved toner blocking resistance, a toner such as described below is used. Specifically, the toner includes toner particles that each have a core-shell structure in which a toner core is coated by a shell layer. In a toner such as described above, the toner cores contain a binder resin having a low melting temperature. The shell layers are made from a resin that has a higher glass transition point (Tg) than the binder resin included in the toner core.

As an example of a toner including toner particles having a core-shell structure such as described above, a toner has been proposed in which toner cores having a softening temperature of no less than 40° C. and no greater than 150° C. while in a uncoated state, are each coated by a thin film containing a thermosetting resin.

SUMMARY

An electrostatic latent image developing toner includes toner particles. Each of the toner particles includes a toner core containing a binder resin and a releasing agent, and a shell layer coating the toner core. The releasing agent has a melting point $Mp^r$ of no less than 50° C. and no greater than 100° C. The releasing agent has a number average dispersion diameter of no less than 30 nm and no greater than 500 nm. The shell layer is made from a resin including a unit derived from a monomer of a thermosetting resin. The thermosetting resin is one or more resins selected from the group of amino resins consisting of a melamine resin, a urea resin, and a glyoxal resin.

BRIEF DESCRIPTION OF THE DRAWINGS

FIG. 1 is a diagram relating to a method for measuring a softening point using an elevated flow tester.

DETAILED DESCRIPTION

The following provides detailed explanation of an embodiment of the present disclosure. However, the present disclosure is of course not limited by the embodiment and appropriate variations within the intended scope of the present disclosure can be made when implementing the present disclosure. Also note that explanation is omitted where appropriate in order to avoid repetition, but such omission does not limit the substance of the present disclosure.

An electrostatic latent image developing toner (herein also referred to simply as a toner) according to the present disclosure includes toner particles. Each of the toner particles includes a toner core containing a binder resin and a releasing agent, and a shell layer coating the toner core. In addition to the binder resin and the releasing agent, the toner core may further contain a colorant, a charge control agent, and a magnetic powder in accordance with necessity thereof. The releasing agent has a melting point ($Mp^r$) of no less than 50° C. and no greater than 100° C. The releasing agent has a number average dispersion diameter of no less than 30 nm and no greater than 500 nm. The shell layer is made from a resin including a unit derived from a monomer of a thermosetting resin. In addition to the toner particles, the toner according to the present disclosure may also include components other than the toner particles.

The surface of the toner particles included in the toner may be treated as necessary using an external additive. In the description and claims of the present disclosure, the term "toner mother particles" is also used to refer to toner particles prior to treatment with an external additive. The toner can also be mixed with a desired carrier and used as a two-component developer. The following explains the binder resin, the releasing agent, the colorant, the charge control agent, and the magnetic powder, which are essential or optional components of the toner core, the resin forming the shell layers, the external additive, and the carrier when the toner is used as a two-component developer. The following also explains a method for manufacturing the toner.

[Binder Resin]

There is no particular limit on composition of the binder resin, so long as the binder resin is a resin that can be used as a binder resin in a toner. As explained further below, toner particles included in the toner according to the present disclosure are prepared by hardening of a material of the shell layers, which contains a thermosetting resin monomer, such that the shell layers coat the toner cores. When the binder resin includes a functional group such as a hydroxyl group or a carboxyl group that can react with the thermosetting resin monomer, the functional group is exposed at the surface of the toner cores containing the binder resin. Therefore, when the binder resin has a functional group such as a hydroxyl group or a carboxyl group, during coating of the toner cores with the shell layers, the functional group such as a hydroxyl group or a carboxyl group exposed at the surface of the toner cores reacts with a thermosetting resin monomer such as methylol melamine. Through the above reaction, covalent bond formation occurs between the toner cores and the shell layers. Thus, when the toner cores contain a binder resin having a functional group such as a hydroxyl group or a carboxyl group, the toner cores become strongly bound to the shell layers.

The binder resin having a functional group such as a hydroxyl group or a carboxyl group may for example be a thermoplastic resin. Specific examples of thermoplastic resins that can be used as the binder resin include acrylic-based resins, styrene acrylic-based resins, polyester resins, polyamide resins, polyurethane resins, and polyvinyl alcohol-based resins. Among the resins listed above, a polyester resin is preferable in terms of dispersion characteristics of the colorant in the toner core, charging characteristics of the toner particles, and fixability of the toner with respect to paper. The following explains the polyester resin.

The polyester resin used as the binder resin can be selected as appropriate from among polyester resins that are used as binder resins in toners. The polyester resin can be obtained through condensation polymerization or condensation copolymerization of an alcohol and a carboxylic acid. The following are examples of alcohols and carboxylic acids that can be used as a monomer of the polyester resin used as the binder resin.

The alcohol used as the polyester resin monomer may for example be a dihydric alcohol or an alcohol having three or more hydroxyl groups such as listed below.

Examples of the dihydric alcohol include a diol and a bisphenol. Specific examples of the diol include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol. Specific examples of the bisphenol include bisphenol A, hydrogenated bisphenol A, polyoxyethlyene bisphenol A, polyoxypropylene bisphenol A.

Examples of the alcohol having three or more hydroxyl groups include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

The carboxylic acid used as the polyester resin monomer may for example be a dicarboxylic acid or a carboxylic acid having three or more carboxyl groups.

Specific examples of the dicarboxylic acid include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and alkyl succinic acids or alkenyl succinic acids (for example, n-butyl succinic acid, n-butenyl succinic acid, isobutyl succinic acid, isobutenyl succinic acid, n-octyl succinic acid, n-octenyl succinic acid, n-dodecyl succinic acid, n-dodecenyl succinic acid, isododecyl succinic acid, and isododecenyl succinic acid).

Specific examples of the carboxylic acid having three or more carboxyl groups include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

The dicarboxylic acids and the carboxylic acids having three or more carboxyl groups listed above may be used in a derivative form having ester formation properties such as an acid halide, an acid anhydride, or a lower alkyl ester. Herein, the term lower alkyl refers to an alkyl group having no less than one and no greater than six carbon atoms.

Preferably the polyester resin has a mass average molecular weight (Mw) of no less than 10,000 and no greater than 50,000. Preferably the polyester resin has a molecular weight distribution (Mw/Mn) (i.e., dispersity), expressed as a ratio of the mass average molecular weight (Mw) relative to a number average molecular weight (Mn) of the polyester resin, of no less than 8 and no greater than 50. When the mass average molecular weight (Mw) and the molecular weight distribution (Mw/Mn) of the polyester resin are within the ranges described above, the toner, which includes toner particles prepared using toner cores containing the polyester resin, has excellent high-temperature preservability and low-temperature fixability, and can restrict occurrence of offset during fixing at high temperatures. The mass average molecular weight (Mw) and the number average molecular weight (Mn) of the polyester resin can be measured by gel permeation chromatography (GPC). The following explains a method for measuring molecular weight by GPC.

<Method for Measuring Molecular Weight by GPC>

Tetrahydrofuran (THF) is used as a solvent. A measurement sample is added to the THF such as to have a concentration of 3.0 mg/mL. A resulting mixture of the THF and the measurement sample is left to stand for one hour in order to dissolve the measurement sample in the THF. A resulting THF solution is filtered using a pre-treatment filter (for example, Chromatodisc 25N manufactured by Kurabo Industries Ltd., non-aqueous, pore size 0.45 nm), thereby obtaining a measurement sample solution. Measurement by GPC is performed using equipment and conditions described below. Specifically, a column is stabilized in a heat chamber at 40° C. and THF is passed along the column at a rate of 1 mL/minute. Next, 50 μL to 200 μL of the measurement sample solution is introduced to the column and measured by GPC.

A molecular weight distribution of the measurement sample is calculated based on a relationship between a calibration curve of logarithmic values and a count value (retention time). The calibration curve is prepared using standard samples of a plurality of types of monodispersed polystyrene. Examples of suitable standard samples of monodispersed polystyrenes that can be used include standard polystyrenes of molecular weights $3.84\times10^6$, $1.09\times10^6$, $3.55\times10^5$, $1.02\times10^5$, $4.39\times10^4$, $9.10\times10^3$ and $2.98\times10^3$ manufactured by Tosoh Corporation. Use of a refractive index (RI) detector is preferable in terms that the RI detector can detect the sample regardless of composition thereof. The column can be a combination of standard polystyrene gel columns. The following is an example of suitable GPC measurement conditions.

(GPC Measurement Conditions)

Apparatus: HLC-8220 (manufactured by Tosoh Corporation)
Eluent: THF
Column: TSKgel GMHx1 (manufactured by Tosoh Corporation)
Number of columns: 2
Detector: RI
Elution rate: 1 mL/minute
Sample solution concentration: 3.0 mg/mL
Column temperature: 40° C.
Sample solution volume: 100 μL
Calibration curve: Prepared using standard polystyrene When a polyester resin is used as the binder resin, the polyester resin preferably has an acid value of no less than 5 mg KOH/g and no greater than 30 mg KOH/g. Also, the polyester resin preferably has a hydroxyl value of no less than 15 mg KOH/g and no greater than 80 mg KOH/g.

The acid value and the hydroxyl value of the polyester resin can be adjusted through appropriate adjustment of the amount of the alcohol (dihydric alcohol or alcohol having three or more hydroxyl groups) and the amount of the carboxylic acid (dicarboxylic acid or carboxylic acid having three or more carboxyl groups) used in preparation of the polyester resin. Note that the acid value and the hydroxyl value of the polyester resin tend to decrease in response to an increase in the molecular weight of the polyester resin.

From a viewpoint of carbon neutrality, preferably the toner according to the present disclosure includes a material derived from biomass. More specifically, preferably no less than 25% by mass and no greater than 90% by mass of total carbon content of the toner is derived from biomass.

In consideration of the above, when a polyester resin is used as the binder resin, the polyester resin is preferably synthesized using an alcohol derived from biomass (for example, 1,2-propanediol, 1,3-propanediol, or glycerin). There is no particular limitation on the type of biomass, and the biomass may be either plant biomass or animal biomass. Among materials derived from biomass, materials derived from plant biomass are particularly preferable in terms of low-cost and availability in large amounts. In an example of a method for manufacturing glycerin from biomass, vegetable oil or animal fat is hydrolyzed through a chemical method using an acid or a base. In another example of a method for manufacturing glycerin from biomass, vegetable oil or animal fat is hydrolyzed through a biological method using an enzyme or a microorganism. Furthermore, glycerin can be manufactured from a substrate including saccharides, such as glucose, through a fermentation method. Alcohols such as 1,2-propanediol and 1,3-propanediol can be manufactured using glycerin obtained as described above as a raw material, by chemically converting the glycerin into the target substance in accordance with a commonly known method.

The concentration of $CO_2$ containing radiocarbon ($^{14}C$) remains constant among $CO_2$ present in the atmosphere. Plants absorb $^{14}C$-containing $CO_2$ from the atmosphere during the process of photosynthesis. As a consequence, the concentration of $^{14}C$ among carbon contained in an organic component of a plant generally corresponds to the concentration of $^{14}C$-containing $CO_2$ in the atmosphere. The concentration of $^{14}C$ among carbon contained in the organic component of the plant is approximately 107.5 percent modern carbon (pMC). Note that carbon in animals is derived from carbon included in plants. Therefore, the concentration of $^{14}C$ among carbon contained in an organic component of an animal tends to be similar to that in plants.

Supposing that the concentration of $^{14}C$ in the toner is X pMC, a percentage of carbon in the toner that is derived from biomass can be calculated according to Expression 1 shown below.

$$\text{Percentage of carbon derived from biomass (\% by mass)} = (X/107.5) \times 100 \quad \text{<Expression 1>}$$

A plastic product for which at least 25% by mass of carbon contained therein is derived from biomass is preferable from a viewpoint of carbon neutrality. Such a plastic product is eligible to receive a BiomassPla mark (certified by the Japan BioPlastics Association). When at least 25% by mass of carbon contained in the toner is derived from biomass, it is possible to calculate that the concentration X of $^{14}C$ in the toner is at least 26.9 pMC based on Expression 1. Therefore, preferably the polyester resin should be prepared such that the concentration of the radioactive carbon isotope $^{14}C$ among carbon contained in the toner is at least 26.9 pMC. Note that the concentration of $^{14}C$ among carbon contained in a petrochemical product is measured in accordance with ASTM-D6866.

When a polyester resin is used as the binder resin, the polyester resin may contain crystalline polyester resin. In the description and claims of the present disclosure, the term crystalline polyester resin refers to polyester resin having a crystallinity index of at least 0.90 and less than 1.10, and preferably no less than 0.98 and no greater than 1.05. When the toner cores used to prepare the toner particles of the toner contain crystalline polyester resin, the toner has excellent low-temperature fixability and can restrict occurrence of offset during fixing at high temperatures.

The crystalline polyester resin can be obtained through condensation polymerization or condensation copolymerization of an alcohol and a carboxylic acid. The alcohol used in synthesis of the crystalline polyester resin may for example be any of the dihydric alcohols or the alcohols having three or more hydroxyl groups listed above as examples of the monomer of the polyester resin used as the binder resin. Likewise, the carboxylic acid used in synthesis of the crystalline polyester resin may for example be any of the dicarboxylic acids or the carboxylic acids having three or more carboxyl groups listed above as examples of the monomer of the polyester resin used as the binder resin.

Among the alcohols listed above, aliphatic diols having no less than two and no greater than eight carbon atoms are preferable in terms of encouraging polyester resin crystallization. Also, among the aliphatic diols, α,ω-alkanediols having no less than two and no greater than eight carbon atoms are particularly preferable in terms of encouraging polyester resin crystallization.

In order to obtain crystalline polyester resin, aliphatic diols having no less than 2 and no greater than 10 carbon atoms preferably have a mole percentage of at least 80% in the alcohol, and more preferably have a mole percentage of at least 90%.

Furthermore, in order to obtain crystalline polyester resin, a major constituent of the alcohol (i.e., a single chemical compound) preferably has a mole percentage of at least 70%, more preferably has a mole percentage of at least 90%, and most preferably has a mole percentage of 100%.

Among the carboxylic acids listed above, aliphatic dicarboxylic acids having no less than two and no greater than 16 carbon atoms, and in particular α,ω-alkane dicarboxylic acids having no less than two and no greater than 16 carbon atoms, are preferable in terms of encouraging polyester resin crystallization.

In order to obtain crystalline polyester resin, aliphatic dicarboxylic acids having no less than 2 and no greater than 16 carbon atoms preferably have a mole percentage of at least 70% in the carboxylic acid, and more preferably have a mole percentage of at least 90%. Furthermore, in order to obtain crystalline polyester resin, a major constituent of the carboxylic acid (i.e., a single chemical compound) preferably has a mole percentage of at least 70%, more preferably has a mole percentage of at least 90%, and most preferably has a mole percentage of 100%.

A crystallinity index of the crystalline polyester resin can be calculated from a ratio ($Tm^c/Mp^c$) of a softening point ($Tm^c$) of the crystalline polyester resin relative to a melting point (temperature corresponding to a highest peak on a differential scanning calorimetry (DSC) curve indicating heat absorption, $Mp^c$) of the crystalline polyester resin.

When a polyester resin containing crystalline polyester resin is used as the binder resin, the crystalline polyester resin preferably has a melting point ($Mp^c$) of no less than 30° C. and no greater than 100° C., and more preferably has a melting point ($Mp^c$) of no less than 50° C. and no greater than 100° C., as measured using a differential scanning calorimeter. When the toner cores used to prepare the toner particles of the toner contain crystalline polyester resin having a melting point ($Mp^c$) in the range described above, the toner has excellent high-temperature preservability and low-temperature fixability, and can particularly effectively restrict occurrence of offset during fixing at high temperatures. The melting point ($Mp^c$) of the crystalline polyester resin can be measured by a differential scanning calorimeter according to the following method.

The softening point ($Tm^c$) of the crystalline polyester resin can be measured by a flow tester according to the same method as described further below for measuring a softening point of the binder resin.

<Method for Melting Point Measurement>

A DSC6220 (manufactured by Seiko Instruments Inc.) is used as the differential scanning calorimeter. A sample of the crystalline polyester resin in a range of 10 mg to 20 mg is placed in an aluminum pan and the aluminum pan is set in a measurement section of the differential scanning calorimeter. An empty aluminum pan is used as a reference. The temperature of the sample is increased to 170° C. at a rate of 10° C./minute from a measurement starting temperature of 30° C. The melting point ($Mp^c$) of the crystalline polyester resin is determined to be a temperature corresponding to a maximum of enthalpy of fusion observed while increasing the temperature.

The crystallinity index of the polyester resin can be adjusted through appropriate adjustment of the type and amount of the alcohol or carboxylic acid which is a monomer of the polyester resin. A single crystalline polyester may be used or a combination of two or more crystalline polyesters may be used.

When a polyester resin is used as the binder resin, a ratio (P/Q) of crystalline polyester resin content (P) of the polyester resin relative to polyester resin content (Q) of the polyester resin exclusive of the crystalline polyester resin (specifically, amorphous polyester resin) is preferably no less than 1/99 and no greater than 30/70.

The glass transition point (Tg) of the binder resin is preferably no less than 30° C. and no greater than 60° C., and more preferably is no less than 35° C. and no greater than 55° C. The glass transition point (Tg) can be measured according to the following method.

The glass transition point (Tg) of the binder resin can be calculated from an inflection point of specific heat of the binder resin using a differential scanning calorimeter. More specifically, a differential scanning calorimeter is used as a measurement apparatus (for example, DSC-6200 manufactured by Seiko Instruments Inc.). The glass transition point (Tg) of the binder resin can be calculated by using the differential scanning calorimeter to obtain a heat absorption curve of the binder resin. A 10 mg measurement sample is placed in an aluminum pan. An empty aluminum pan is used as a reference. Measurement is performed in a measurement temperature range of 25° C. to 200° C. with a heating rate of 10° C./minute. The glass transition point (Tg) of the binder resin can be calculated from the heat absorption curve of the binder resin obtained through measurement under the conditions described above.

The softening point (Tm) of the binder resin is preferably no less than 60° C. and no greater than 150° C., and more preferably is no less than 70° C. and no greater than 140° C. Note that alternatively a plurality of resins, each having a different softening point (Tm), can be used in combination such that the binder resin has a softening point within the range described above. The softening point of the binder resin can be measured according to the following method.

<Method for Softening Point Measurement>

The softening point (Tm) of the binder resin is measured using an elevated flow tester (for example, capillary rheometer CFT-500D manufactured by Shimadzu Corporation). A measurement sample is set in the elevated flow tester (capillary rheometer). The softening point (Tm) is measured by melt-dissolution flow of 1 $cm^3$ of the sample under the following conditions. Specific examples of conditions are a die diameter of 1 mm, a plunger load of 20 $kg/cm^2$, and a heating rate of 6° C./minute. An S-shaped curve of temperature (° C.)/stroke (mm) is obtained through measurement by the elevated flow tester (capillary rheometer). The softening point (Tm) of the binder resin is read from the S-shaped curve.

The following explains a method for reading the softening point (Tm) with reference to FIG. 1. In FIG. 1, $S_1$ is a maximum stroke value and $S_2$ is a base-line stroke value at low-temperature. The softening point (Tm) of the measurement sample is read as a temperature on the S-shaped curve corresponding to a stroke value of $(S_1+S_2)/2$.

[Releasing Agent]

The toner cores contain a releasing agent in order to improve fixability and offset resistance of the toner. The releasing agent has a melting point ($Mp^r$) of, for example, no less than 50° C. and no greater than 100° C., and preferably no less than 70° C. and no greater than 85° C. The melting point ($Mp^r$) of the releasing agent can for example be measured by a differential scanning calorimeter.

When the toner cores used to prepare the toner particles of the toner contain a releasing agent having a melting point ($Mp^r$) in the range described above, the toner has excellent low-temperature fixability. A toner such as described above can also restrict occurrence of offset during fixing at high temperatures and can form an image with excellent glossiness.

If the toner cores used to prepare the toner particles of the toner contain a releasing agent having an excessively low melting point ($Mp^r$), offset may occur during fixing at high temperatures and it may not be possible to form an image with excellent glossiness when performing image formation using the toner.

If the toner cores used to prepare the toner particles of the toner contain a releasing agent having an excessively high melting point ($Mp^r$), the toner may be poorly fixed at low temperature and it may not be possible to form an image with excellent glossiness when image formation is performed using the toner. The melting point ($Mp^r$) of the releasing agent can for example be measured by a differential scanning calorimeter according to the method described below.

<Method for Melting Point Measurement>

A DSC6220 (manufactured by Seiko Instruments Inc.) is used as the differential scanning calorimeter. A 10 mg sample of the releasing agent is placed in an aluminum pan and the aluminum pan is set in a measurement section of the differential scanning calorimeter. An empty aluminum pan is used as a reference. First, the temperature of the sample is increased from 10° C. to 150° C. at a rate of 10° C./minute. Next, the sample is cooled to 10° C. at a rate of 10° C./minute. The sample is subsequently reheated to 150° C. at a rate of 10° C./minute. The melting point ($Mp^r$) of the releasing agent is determined to be a temperature corresponding to a maximum of enthalpy of fusion (heat absorption peak) on a DSC curve during the reheating.

The releasing agent is preferably a wax. Examples of the wax include ester waxes, polyethylene waxes, polypropylene waxes, fluororesin-based waxes, Fischer-Tropsch waxes, paraffin waxes, and montan waxes. The ester wax can be a synthetic ester wax or a natural ester wax (for example, carnauba wax or rice wax). A single releasing agent such as listed above may be used or a combination of two or more releasing agents may be used. Among the listed releasing agents, ester waxes are particularly preferable.

Furthermore, among ester waxes, synthetic ester waxes are preferable. Through appropriate selection of a synthetic raw material for the releasing agent, the melting point ($Mp^r$) of the releasing agent as measured by the differential scanning calorimeter (i.e., the temperature corresponding to the highest peak on the DSC curve indicating heat absorption) can be adjusted to be within the aforementioned range of no less than 50° C. and no greater than 100° C.

There is no particular limitation on a method for manufacturing the synthetic ester wax, so long as the method is a chemical synthesis. For example, the synthetic ester wax can be synthesized using a commonly known method such as reaction of an alcohol and a carboxylic acid, or an alcohol and a carboxylic acid halide, in the presence of an acid catalyst. Note that the raw material for the synthetic ester wax can for example be a raw material derived from a natural material, such as a long-chain fatty acid manufactured from a natural oil or fat. Alternatively, the synthetic ester wax may be a synthetic ester wax that is commercially available as a synthetic product.

The melting point (Mp′) of the releasing agent in the toner can be measured using a sample of the releasing agent prior to inclusion in the toner core, or can alternatively be measured using a sample of the releasing agent isolated from the toner particles according to the following method.

<Method for Isolating Releasing Agent from Toner Particles>

First, 10 g of the toner is melt-dissolved at 150° C. to obtain a toner melt. Next, the toner melt is cooled to room temperature and thereby solidified to obtain a solid sample. The solid sample is left to stand in methyl ethyl ketone (MEK) for 24 hours at 25° C. A resulting sample is filtered through a glass filter (opening standard 11G-3). Next, a cake deposited on the glass filter is added to 30 mL of toluene at 50° C. The cake-containing toluene is cooled to 25° C. After cooling, the cake-containing toluene is left to stand for four hours at 25° C. A resulting sample is filtered through a glass filter (opening standard 11G-3). After leaving the filtrate to stand for 12 hours, a supernatant liquid is collected therefrom. The supernatant liquid is vacuum-dried at 60° C. to obtain the releasing agent as a resultant residue of the drying.

The amount of the releasing agent is preferably no less than 1 part by mass and no greater than 30 parts by mass relative to 100 parts by mass of the binder resin, and more preferably no less than 5 parts by mass and no greater than 20 parts by mass.

[Colorant]

The toner cores may contain a colorant in accordance with necessity thereof. A commonly known pigment or dye may be used as the colorant in accordance with color of the toner particles. The following describes specific examples of suitable colorants.

Carbon black can for example be used as a black colorant. Alternatively, a colorant which is adjusted to a black color using colorants described below, such as a yellow colorant, a magenta colorant, and a cyan colorant, can be used as the black colorant.

When the toner is a color toner, the colorant contained in the toner cores can for example be a yellow colorant, a magenta colorant, or a cyan colorant.

Examples of the yellow colorant include condensed azo compounds, isoindolinone compounds, anthraquinone compounds, azo metal complexes, methine compounds, and allylamide compounds. More specifically, examples of the yellow colorant include C.I. pigment yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, 194, and the like), naphthol yellow S, Hansa yellow G, and C.I. vat yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. More specific examples of the magenta colorant include C.I. pigment red (2, 3, 5, 6, 7, 19, 23, 48:2, 48:3, 48:4, 57:1, 81:1, 122, 144, 146, 150, 166, 169, 177, 184, 185, 202, 206, 220, 221, 254, and the like).

Examples of the cyan colorant include copper phthalocyanine compounds, copper phthalocyanine derivatives, anthraquinone compounds, and basic dye lake compounds. More specific examples of the cyan colorant include C.I. pigment blue (1, 7, 15, 15:1, 15:2, 15:3, 15:4, 60, 62, 66, and the like), phthalocyanine blue, C.I. vat blue, and C.I. acid blue.

The amount of the colorant is preferably no less than 1 part by mass and no greater than 20 parts by mass relative to 100 parts by mass of the binder resin, and more preferably no less than 3 parts by mass and no greater than 10 parts by mass.

[Charge Control Agent]

The charge control agent is used to improve a charge level or charge rise characteristic, which serves as an index indicating whether the toner can be charged to a predetermined charge level within a short period of time, with the aim of providing the toner with excellent durability and stability. When the shell layers contain a component having a charging function, it is not necessary for the toner cores to contain the charge control agent. A positively chargeable charge control agent is used when the toner is to be positively charged during developing, and a negatively chargeable charge control agent is used when the toner is to be negatively charged during developing.

[Magnetic Powder]

The toner cores may contain magnetic powder in the binder resin in accordance with necessity thereof. When the toner cores used to prepare the toner particles of the toner contain magnetic powder, the toner is used as a magnetic one-component developer. Suitable examples of the magnetic powder include: iron, such as ferrite and magnetite; ferromagnetic metals, such as cobalt and nickel; alloys containing either or both of iron and ferromagnetic metal; compounds containing either or both of iron and ferromagnetic metal; ferromagnetic alloys subjected to ferromagnetization, such as thermal treatment; and chromium dioxide.

The magnetic powder preferably has a particle diameter of no less than 0.1 μm and no greater than 1.0 μm, and more preferably no less than 0.1 μm and no greater than 0.5 μm. A magnetic powder having a particle diameter falling within the range described above can readily be dispersed uniformly in the binder resin.

When the toner is used as a one-component developer, the amount of the magnetic powder in the toner is preferably no less than 35 parts by mass and no greater than 60 parts by mass relative to 100 parts by mass of the toner, and more preferably no less than 40 parts by mass and no greater than 60 parts by mass. When the toner is used as a two-component developer, the amount of the magnetic powder in the toner is preferably no greater than 20 parts by mass relative to 100 parts by mass of the toner, and more preferably no greater than 15 parts by mass.

[Resin Forming Shell Layers]

A resin forming the shell layers contains a unit derived from a monomer of a thermosetting resin. In the description and claims of the present disclosure, the term "unit derived from a monomer of a thermosetting resin" refers to a unit that is for example obtained by introducing a methylene group (—$CH_2$—) derived from formaldehyde into a monomer such as melamine. Thus, the shell layers are made from a resin including a unit derived from a monomer of a thermosetting resin (more specifically, one or more resins selected from the group of amino resins consisting of a melamine resin, a urea resin, and a glyoxal resin). The following describes thermosetting resin monomers that are appropriate for inclusion in the resin for forming the shell layers.

{Thermosetting Resin Monomer}

The monomer used to introduce a unit derived from a monomer of a thermosetting resin into the resin for forming the shell layers is a monomer or an initial condensate used to form one or more thermosetting resins selected from the group of amino resins consisting of a melamine resin, a urea resin, and a glyoxal resin.

The melamine resin is a polycondensate of melamine and formaldehyde. Thus, melamine is the monomer used to form the melamine resin. The urea resin is a polycondensate of urea and formaldehyde. Thus, urea is the monomer used to form the urea resin. The glyoxal resin is a polycondensate of formaldehyde and a reaction product of glyoxal and urea. Thus, the reaction product of glyoxal and urea is the monomer used to form the glyoxal resin. The melamine for forming the melamine resin, the urea for forming the urea resin, and the urea for reaction with glyoxal in forming of the glyoxal resin may each be modified in a known manner. The monomer of the thermosetting resin may be methylolated with formaldehyde before formation of the shell layers, and thus may be used as a derivative.

A unit derived for a thermoplastic resin having a functional group that is reactive with a functional group, such as a methylol group or an amino group, of the monomer of the thermosetting resin described above may be introduced into the resin forming the shell layers. As a result of the resin forming the shell layers including both the unit derived from the monomer of the thermosetting resin and the unit derived from the thermoplastic resin, it is possible to obtain toner particles including shell layers having suitable flexibility resulting from the unit derived from the thermoplastic resin, and suitable mechanical strength resulting from a three-dimensional cross-linking structure formed by the monomer of the thermosetting resin.

The functional group that is reactive with a functional group, such as a methylol group or an amino group, of the monomer of the aforementioned thermosetting resin, may for example be a functional group including an active hydrogen atom, such as a hydroxyl group, a carboxyl group, or an amino group. The amino group may be contained in the thermoplastic resin in the form of a carbamoyl group (—$CONH_2$). In terms of allowing simple formation of the shell layers, preferred examples of the thermoplastic resin include a resin containing a unit derived from either or both of acrylamide and methacrylamide and a resin containing a unit derived from a monomer having a functional group such as a carbodiimide group, an oxazoline group, or a glycidyl group.

In the resin forming the shell layers, the content of the unit derived from the monomer of the thermosetting resin is preferably at least 70% by mass, more preferably at least 80% by mass, particularly preferably at least 90% by mass, and most preferably 100% by mass.

Thickness of each of the shell layers is preferably no less than 1 nm and no greater than 20 nm, and more preferably no less than 1 nm and no greater than 10 nm. If the toner particles include shell layers that are excessively thick, the shell layers may not rupture upon pressure being applied to the toner particles during fixing of the toner to a recording medium during image formation using the toner. In such a situation, softening or melting of the binder resin or the releasing agent contained in the toner core may not progress smoothly, making it difficult to fix the toner to the recording medium at low temperatures. On the other hand, shell layers that are excessively thin are low in strength. Shell layers having low strength may rupture due to an impact, for example occurring during transport. When a toner is stored at high temperatures, toner particles having at least partially ruptured shell layers may aggregate. The aforementioned aggregation occurs due to components of the toner particles, such as the releasing agent, exuding to the surface of the toner particles through the ruptured parts of the shell layers at high temperatures.

Thickness of a shell layer can be measured by analyzing a transmission electron microscopy (TEM) image of a cross-section of a toner particle using commercially available image-analyzing software. Examples of the commercially available image-analyzing software include WinROOF (provided by Mitani Corporation). More specifically, on the cross-section of a toner particle, two straight lines are drawn to intersect at right angles at approximately the center of the cross-section. Lengths of segments of the two lines crossing the shell layer are measured at four locations. An average value of the lengths measured at the four locations is determined to be the thickness of the shell layer of the toner particle which is a measurement target. In this way, shell layer thickness is measured for at least ten toner particles and an average value of thicknesses of the respective shell layers of the measurement target toner particles is calculated. The calculated average value is determined to be the thickness of the shell layers of the toner particles.

When the shell layer is excessively thin, the TEM image may not clearly depict a boundary between the shell layer and the toner core, complicating measurement of thickness of the shell layer. In such a situation, in order that thickness of the shell layer can be measured, TEM imaging may be used in combination with energy dispersive X-ray spectroscopic analysis (EDX) to clarify the boundary between the shell layer and the toner core. The boundary is clarified through mapping of a characteristic element such as nitrogen in a material of the shell layer in the TEM image.

The thickness of the shell layers can be adjusted by adjusting the amounts of materials used to form the shell layers such as the thermosetting resin monomer. The thickness of the shell layers can be calculated based on the amount of the thermosetting resin monomer relative to the specific surface area of the toner cores, as shown in the following expression.

Thickness of shell layer=Amount of thermosetting resin monomer/Specific surface area of toner cores

[External Additive]

An external additive may be adhered to the surface of the toner particles included in the toner according to the present disclosure in accordance with necessity thereof.

The external additive may for example be silica or a metal oxide. Examples of the metal oxide include alumina, titanium oxide, magnesium oxide, zinc oxide, strontium titanate, and barium titanate.

The external additive preferably has a particle diameter of no less than 0.01 μm and no greater than 1.0 μm.

The amount of the external additive that is used is preferably no less than 0.5 parts by mass and no greater than 10 parts by mass relative to 100 parts by mass of the toner mother particles.

[Carrier]

The toner may be mixed with a desired carrier and used as a two-component developer. In a situation in which the two-component developer is manufactured, preferably a magnetic carrier is used.

Preferable examples of the carrier include a carrier whose particles have resin-coated carrier cores. Specific examples of the carrier core include: particles of iron, oxidized iron, reduced iron, magnetite, copper, silicon steel, ferrite, nickel, or cobalt; particles of alloys of one or more of the above-listed materials and a metal such as manganese, zinc, or aluminum; particles of iron-nickel alloys or iron-cobalt alloys; particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate; and particles of high-dielectric substances, such as ammonium dihydrogen phosphate, potassium dihydrogen phosphate, or Rochelle salt. The carrier may also be a resin carrier having any of the above listed magnetic particles dispersed therein. Particles of a single type may be used or alternatively particles of two or more different types may be used in combination.

Examples of the resin coating the carrier core include acrylic-based polymers, methacrylic-based polymers, styrene-based polymers, styrene-acrylic-based copolymers, styrene-methacrylic-based copolymers, olefin-based polymers (e.g., polyethylene, chlorinated polyethylene, and polypropylene), polyvinyl chlorides, polyvinyl acetates, polycarbonates, cellulose resins, polyester resins, unsaturated polyester resins, polyamide resins, polyurethane resins, epoxy resins, silicone resins, fluorine resins (e.g., polytetrafluoroethylene, polychlorotrifluoroethylene, and polyvinylidene fluoride), phenolic resins, xylene resins, diallylphthalate resins, polyacetal resins, and amino resins. The above-listed resins may be used singly or as a combination of two or more types.

The particle diameter of the carrier measured under an electron microscope is preferably no less than 20 μm and no greater than 120 μm, and more preferably no less than 25 μm and no greater than 80 μm.

When the toner is used as a two-component developer, the amount of the toner contained in the two-component developer is preferably no less than 3% by mass and no greater than 20% by mass relative to the mass of the two-component developer, and more preferably no less than 5% by mass and no greater than 15% by mass.

[Method for Manufacturing Toner]

No particular limitation is placed on the method of manufacturing the toner, so long as the method enables coating of the toner cores with the shell layers made from the specific materials described above.

The releasing agent has a number average dispersion diameter of, for example, no less than 30 nm and no greater than 500 nm. Preferably the number average dispersion diameter is no less than 100 nm and no greater than 500 nm, and more preferably is no less than 200 nm and no greater than 500 nm. The number average dispersion diameter of the releasing agent can be measured from a TEM image of a cross-section of a toner particle captured at ×3000 magnification. When the toner cores used to prepare the toner particles of the toner contain a releasing agent dispersed such as to have a number average dispersion diameter in the range described above, the toner exhibits excellent low-temperature fixability. Such a toner can also restrict occurrence of offset during fixing at high temperatures and can be used to form an image having desired glossiness.

If the toner cores used to prepare the toner particles of the toner contain a releasing agent dispersed such as to have a number average dispersion diameter that is excessively low, when the toner is used to form an image, offset may occur during fixing at high temperatures and the image which is formed may not have desired glossiness.

If toner particles of the toner are prepared using toner cores including a releasing agent dispersed such as to have a number average dispersion diameter that is excessively high, when the toner is used to form an image, the toner may not be preferably fixable at low temperatures and the image which is formed may not have desired glossiness. Also, in the situation described above in which the number average dispersion diameter of the releasing agent contained in the toner cores is excessively high, during preparation of the toner using a method for forming suitable shell layers which is explained further below, the shell layers may not be formed uniformly on the surface of the toner cores. If the shell layers are not formed uniformly, components contained in the toner cores such as the releasing agent may readily exude to the surface of the toner particles. Therefore, if the toner cores used to prepare the toner particles of the toner contain a releasing agent dispersed such as to have a number average dispersion diameter that is excessively high, the toner tends to have poor high-temperature preservability.

When the toner cores are prepared using a pulverization method explained further below, the number average dispersion diameter of the releasing agent dispersed therein can be adjusted by appropriately changing melt-kneading conditions during melt-kneading of a mixture of materials contained in the toner cores. For example, the number average dispersion diameter of the releasing agent can be reduced by changing a screw pattern of an extruder to a screw pattern having a high kneading effect. Conversely, the number average dispersion diameter of the releasing agent can be increased by changing the screw pattern of the extruder to a screw pattern having a low kneading effect. The number average dispersion diameter of the releasing agent can also be reduced by lowering a cylinder temperature of the extruder. Conversely, the number average dispersion diameter of the releasing agent can also be increased by raising the cylinder temperature of the extruder. At high cylinder temperatures the mixture in the extruder becomes soft, making it difficult for shear force to act on the mixture. When the toner cores are prepared using an aggregation method explained further below, the number average dispersion diameter of the releasing agent contained in the toner cores used to prepare the toner particles of the toner can be adjusted by adjusting particle diameter of fine particles containing the releasing agent.

The number average dispersion diameter of the releasing agent can for example be measured by capturing a TEM image of a cross-section of a toner particle at ×3000 magnification and analyzing the TEM image using commercially available image-analyzing software. Examples of the commercially available image-analyzing software include WinROOF (provided by Mitani Corporation). More specifically, particle diameter is measured for at least ten releasing agent particles contained in a toner particle depicted in the TEM image. An average value of the measured particle diameters is determined to be a dispersion diameter of the releasing agent contained in the toner particle. Measurement of the dispersion diameter of the releasing agent described above is repeated with respect to at least 30 arbitrary toner particles. Next, an average value for all of the measurement target toner particles is calculated from the dispersion diameters calculated for the releasing agent contained in each of the measurement target toner particles. The average value which is calculated is determined to be the number average dispersion diameter of the releasing agent.

The toner preferably has a glass transition point ($Tg^t$) of no less than 30° C. and no greater than 50° C., and more preferably no less than 35° C. and no greater than 50° C. The toner preferably has a softening point ($Tm^t$) of no less than 70° C. and no greater than 100° C. as measured by an elevated flow tester (capillary rheometer). The glass transition point ($Tg^t$) and the softening point ($Tm^t$) of the toner can be measured using the toner as a sample according to the same methods as described above for measuring the glass transition point and the softening point of the binder resin. In a situation in which the glass transition point ($Tg^t$) of the toner is observed at a plurality of stages during measurement thereof, a lowest temperature at which an observation is made is determined to be the glass transition point ($Tg^t$). When the glass transition point ($Tg^t$) and the softening point ($Tm^t$) of the toner are within the above-described ranges, the toner has preferable high-temperature preservability and low-temperature fixability, and can also restrict occurrence of offset during fixing at high temperatures. The glass transition point ($Tg^t$) and the softening point ($Tm^t$) of the toner can be adjusted by adjusting the type and the composition of the polyester resin and the releasing agent contained in the toner cores.

With regards to a preferable method for manufacturing the electrostatic latent image developing toner according to the present disclosure, the following describes, in order, a method for manufacturing the toner cores and a method for forming the shell layers.

{Method for Manufacturing Toner Cores}

No particular limitation is placed on the method for manufacturing the toner cores, so long as the method enables favorable dispersion of components such as the colorant, the charge control agent, the releasing agent, and the magnetic powder in the binder resin. The method can be selected as appropriate from among commonly known methods. The method for manufacturing the toner cores may for example be a pulverization method or an aggregation method.

<Pulverization Method>

In the pulverization method, once the binder resin and releasing agent, which are essential components, and the optional components (for example, the colorant, the charge control agent, and the magnetic powder) have been mixed, the mixture is melt-kneaded to obtain a melt-knead. The melt-knead is pulverized and classified in order to obtain toner cores of a desired particle diameter. An advantage of the pulverization method compared to the aggregation method explained below is that the toner cores can be easily manufactured. On the other hand, a disadvantage of the pulverization method compared to the aggregation method is that as a result of the toner cores being obtained through a pulverization process, it is difficult to obtain the toner cores with high average roundness. However, during a process for forming the shell layers explained further below, while a hardening reaction of the shell layers is occurring due to heating of the raw material for forming the shell layers, the toner cores become relatively soft and contract due to surface tension. The aforementioned softening and contraction of the toner cores causes spheroidizing of the toner cores. In consideration of the above, it is not a major disadvantage that the toner cores have a somewhat low average roundness when manufactured according to the pulverization method. Therefore, preferably the pulverization method is used as the method for manufacturing the toner cores used in the manufacture of the toner according to the present disclosure.

<Aggregation Method>

In the aggregation method, fine particles containing components for forming the toner, such as the binder resin, the releasing agent, and the colorant, are aggregated in an aqueous medium to obtain aggregated particles. The aggregated particles are subsequently heated in order to coalesce the components included in the aggregated particles, thereby obtaining an aqueous dispersion including the toner cores. Washed toner cores are obtained through removal of components such as a dispersant from the aqueous dispersion. The shell layers are formed on the aforementioned toner cores according to a method explained further below. The process described above can be used to obtain toner particles (toner mother particles) that are the same as toner particles obtained when the toner cores are manufactured according to the pulverization method.

The toner cores preferably have a negative (i.e., less than 0 mV) zeta potential, and more preferably have a zeta potential of less than or equal to −10 mV as measured in an aqueous medium adjusted to pH 4. The following explains a specific example of a method for measuring the zeta potential of the toner cores in the aqueous medium adjusted to pH 4.

<Method for Measuring Zeta Potential of Toner Cores in pH 4 Aqueous Medium>

A magnetic stirrer is used to mix 0.2 g of the toner cores, 80 mL of ion exchanged water, and 20 g of a 1% concentration non-ionic surfactant (polyvinylpyrrolidone, K-85 manufactured by Nippon Shokubai Co. Ltd.). A dispersion is obtained in which the toner cores are dispersed uniformly throughout the solvent. The dispersion is subsequently adjusted to pH 4 through addition of dilute hydrochloric acid, thereby obtaining a pH 4 dispersion of the toner cores. Using the pH 4 dispersion of the toner cores as a measurement sample, the zeta potential of the toner cores in the dispersion is measured using a zeta potential and particle distribution measuring apparatus (DelsaNano HC manufactured by Beckman Coulter, Inc.).

A tumbler mixer is used to mix a standard carrier and toner cores of 7% by mass relative to the standard carrier for 30 minutes. In such a situation, the toner cores preferably have a negative (i.e., less than 0 μC/g) triboelectric charge, and more preferably have a triboelectric charge of less than or equal to −10 μC/g. The following explains a specific example of a method for measuring the triboelectric charge.

<Method for Measuring Triboelectric Charge>

The toner cores and a standard carrier N-01 (standard carrier for use with negative-charging toners) provided by The Imaging Society of Japan are mixed for 30 minutes using a tumbler mixer. The amount of the toner cores used during the above is determined such that the toner cores have a concentration of 7% by mass relative to mass of the standard carrier. After mixing, the triboelectric charge of the toner cores is measured by a Q/m meter (Model 210HS-2A manufactured by TREK, Inc.). The triboelectric charge of the toner cores measured according to the method described above indicates tendency of the toner cores to be charged and whether such charging tends to be to positive or negative polarity.

In order to form uniform shell layers on the surface of the toner cores, it is normally necessary for the toner cores to be dispersed to a high degree in an aqueous medium including a dispersant. However, when the triboelectric change of the toner cores with the standard carrier under specific conditions is a negative value within a specific range, the thermosetting resin monomer, which is a nitrogen containing compound that is positively charged in the aqueous medium, is electrically attracted toward the toner cores. Thus, a reaction proceeds favorably at the surface of the toner cores between the thermoplastic resin and the thermosetting resin monomer adhering to the toner cores. Therefore, when the toner cores on which the shell layers are to be formed are negatively charged in the aqueous medium, the shell layers can be uniformly formed on the surface of the toner cores without needing to use the dispersant to achieve a high degree of dispersion of the toner cores in the aqueous medium.

The same effect can be achieved during formation of the shell layers on the surface of the toner cores in the aqueous medium when the zeta potential of the toner cores in the pH 4 aqueous medium, as measured according to the method described above, is within a specific range.

When the toner cores used to manufacture the toner particles have a negative triboelectric charge within the aforementioned specific range with the standard carrier, a negative zeta potential within the aforementioned specific range in the pH 4 aqueous medium, or both of the above, toner particles in which the shells layers uniformly coat the toner cores can be obtained without using a dispersant. By manufacturing the toner particles without using a dispersant, which imposes an extremely high drainage load, the total organic carbon concentration in drainage during manufacture of the toner particles can be kept at a low level (for example, no greater than 15 mg/L), even without dilution of the drainage.

{Method for Forming Shell Layers}

The shell layers coating the toner cores are formed using a monomer of a thermosetting resin monomer (for example, melamine, urea, a reaction product of glyoxal and urea, and/or a precursor (methylol compound) generated through an addition reaction of formaldehyde and any of the above). A thermoplastic resin may also be used in formation of the shell layers in accordance with necessity thereof. During formation of the shell layers, it is necessary to prevent dissolution of the binder resin in the solvent used in shell layer formation and elution of components such as the releasing agent contained in the toner cores. In consideration of the above, shell layer formation is preferably performed in water or a similar solvent.

In shell layer formation, preferably the toner cores are added to an aqueous solution of materials for forming the shell layers. Once the toner cores have been added, the toner cores are dispersed in the aqueous medium. One example of a method for achieving good dispersion of the toner cores in the aqueous medium involves mechanically dispersing the toner cores using an apparatus capable of vigorously stirring the dispersion.

A preferable example of the apparatus capable of mechanically dispersing the toner cores in the aqueous medium by vigorous stirring the dispersion is HIVIS MIX (manufactured by PRIMIX Corporation).

The aqueous solution of the materials for forming the shell layers is preferably adjusted to a pH of approximately 4 using an acidic substance, prior to addition of the toner cores to the aqueous solution. Acidic pH adjustment of the dispersion encourages a polycondensation reaction of the materials used to form the shell layers as explained further below.

Once pH of the aqueous solution of the materials for forming the shell layers has been adjusted as necessary, the toner cores and the materials for forming the shell layers are mixed in the aqueous medium. A reaction between the materials for forming the shell layers occurs at the surface of the toner cores in the aqueous dispersion, thereby forming the shell layers such as to coat the toner cores.

During formation of the shell layers, the temperature is preferably no less than 40° C. and no greater than 95° C., and more preferably is no less than 50° C. and no greater than 80° C. Shell layer formation occurs favorably when performed at a temperature within a range such as described above.

Once the shell layers have been formed as described above, a dispersion of toner particles (toner mother particles) can be obtained by cooling the aqueous dispersion including the toner cores coated by the shell layers to room temperature. The toner is subsequently collected from the dispersion of the toner mother particles by performing, in accordance with necessity thereof, one or more processes among a washing process of washing the toner mother particles, a drying process of drying the toner mother particles, and an external addition process of adhering an external additive to the surface of the toner mother particles. The following explains the washing process, the drying process, and the external addition process.

(Washing Process)

The toner mother particles are washed with water as necessary. A preferred example of a method for washing the toner mother particles involves collecting a wet cake of the toner mother particles through solid-liquid separation from the aqueous dispersion containing the toner mother particles, followed by washing the wet cake with water. Another preferred example of the method for washing the toner mother particles involves precipitating the toner mother particles contained in the aqueous dispersion, substituting the supernatant with water, and re-dispersing the toner mother particles in water.

(Drying Process)

The toner mother particles may be dried as necessary. Preferable examples of a method for drying the toner mother particles include use of a drying apparatus such as a spray dryer, a fluid bed dryer, a vacuum freeze dryer, or a reduced pressure dryer. Among the methods described above, drying using the spray dryer is particularly preferable from a viewpoint of preventing aggregation of the toner mother particles during drying. In a situation in which drying is performed using the spray dryer, an external additive such as silica can be caused to adhere to the surface of the toner mother particles by spraying a dispersion of the external additive together with the dispersion of the toner mother particles.

(External Addition Process)

An external additive may be caused to adhere to the surface of the toner mother particles in accordance with necessity thereof. A preferred example of a method for causing the external additive to adhere to the surface of the toner mother particles, obtained as described above, involves mixing the toner mother particles with the external additive using a mixer, such as an FM mixer or a Nauta® mixer, under conditions that ensure that the external additive is not embedded in the surface of the toner mother particles.

Note that the method for manufacturing the toner described above may be changed freely in accordance with desired configuration, characteristics, and the like of the toner. For example, the process of adding the toner cores to the solvent may alternatively be performed before the process of dissolving the materials for forming the shell layers in the solvent. Non-essential processes may alternatively be omitted. In a method in which an external additive is not caused to adhere to the surface of the toner mother particles (i.e., a method in which the external addition process is omitted), the toner mother particles are equivalent to the toner particles. Preferably a large number of toner particles are formed simultaneously in order to manufacture the toner efficiently.

The above-described electrostatic latent image developing toner according to the present disclosure has excellent high-temperature preservability and low-temperature fixability, can restrict occurrence of offset at high temperatures, and can form an image having excellent glossiness. Therefore, the electrostatic latent image developing toner according to the present disclosure is highly suitable for use in various image forming apparatuses.

EXAMPLES

The following explains specific examples of the present disclosure. Note that the present disclosure is in no way limited to the scope of the examples.

Preparation Example 1

{Preparation of Amorphous Polyester Resins A-F}

First, 1,575 g of polyoxypropylene bisphenol A, 163 g of polyoxyethylene bisphenol A, 377 g of fumaric acid, and 4 g of catalyst (dibutyl tin oxide) were added to a reaction vessel. A nitrogen atmosphere was maintained in the reaction vessel. Next, internal temperature of the reaction vessel was increased to 220° C. while stirring the contents of the reaction vessel. The contents of the reaction vessel were left to react for eight hours at 220° C. Next, the pressure in the reaction vessel was reduced to 60 mm Hg and the contents of the reaction vessel were left to react for a further hour. After the above, a resulting reaction mixture was cooled to 210° C. and 336 g of trimellitic anhydride was added to the reaction vessel. After addition of the trimellitic anhydride, the reaction mixture was left to react at 210° C. until properties of the reaction mixture were as shown in Table 1. Once the reaction was complete, the contents of the reaction vessel were removed from the reaction vessel and cooled to obtain an amorphous polyester resin A. Amorphous polyester resins B-F were obtained by appropriately adjusting preparation conditions, relative to conditions used in preparation of the amorphous polyester resin A, in order to obtain amorphous polyester resins B-F with properties shown in Table 1.

TABLE 1

| | Amorphous polyester resin | | | | | |
|---|---|---|---|---|---|---|
| | A | B | C | D | E | F |
| Mass average molecular weight (Mw) | 30,000 | 28,000 | 10,000 | 49,000 | 23,000 | 30,000 |
| Molecular weight distribution (Mw/Mn) | 15 | 17 | 13 | 35 | 8 | 50 |
| Acid value [mg KOH/g] | 15 | 18 | 30 | 5 | 18 | 12 |
| Hydroxyl value [mg KOH/g] | 35 | 40 | 80 | 15 | 64 | 33 |

Preparation Example 2

{Preparation of Crystalline Polyester Resins A and B}

First, 132 g of 1,6-hexanediol, 230 g of 1,10-decanedicarboxylic acid, 1 g of catalyst (dibutyl tin oxide), and 0.3 g of hydroquinone were added to a reaction vessel. A nitrogen atmosphere was maintained in the reaction vessel. Next, internal temperature of the reaction vessel was increased to 200° C. while stirring the contents of the reaction vessel. The contents of the reaction vessel were left to undergo a polymerization reaction for five hours at 200° C. while evaporating water produced as a by-product. Next, pressure in the reaction vessel was reduced to a range of 5 mm Hg to 20 mm Hg and the polymerization reaction was allowed to continue. The contents of the reaction vessel were left to react at 200° C. until a reaction mixture was obtained having properties shown in Table 2. Once the reaction was complete, the contents of the reaction vessel were removed from the reaction vessel and cooled to obtain a crystalline polyester resin A. A crystalline polyester resin B was obtained by appropriately adjusting preparation conditions, relative to conditions used in preparation of the crystalline polyester resin A, in order to obtain a crystalline polyester resin with properties shown in Table 2. Note that in Table 2, "$Mp^c$" indicates a melting point of the crystalline polyester resin as measured by a differential scanning calorimeter.

TABLE 2

| Crystalline polyester resin | A | B |
|---|---|---|
| $Mp^c$ [° C.] | 50 | 100 |

{Releasing Agents A-F}

Releasing agents A-F were used in the examples and comparative examples. The releasing agents A-F were synthetic ester waxes having the melting points ($Mp^r$) shown in Table 3. The releasing agents A-F were each manufactured by NOF Corporation. Synthetic ester waxes of the types shown in Table 3 were used as the releasing agents A and C. Trial samples of synthetic ester waxes were used as the releasing agents B, and D-F. The melting points ($Mp^r$) of the releasing agents A-F were measured according to the method described below.

{Releasing Agents G and H}

In the examples, releasing agents G and H described below were used as examples of releasing agents that are not synthetic ester waxes. The melting points ($Mp^r$) of the releasing agents G and H were measured according to the method described below.

Releasing agent G: Carnauba wax (trial sample manufactured by KYOCERA Document Solutions Inc., melting point ($Mp^r$) 85° C.)

Releasing agent H: Paraffin wax (Paraffin 155 Wax manufactured by Nippon Seiro Co., Ltd., melting point ($Mp^r$) 70° C.)

<Method for Measuring Melting Point ($Mp^r$)>

DSC was performed using a differential scanning calorimeter DSC6220 (manufactured by Seiko Instruments Inc.). A 10 mg sample of the releasing agent was placed in an aluminum pan and the aluminum pan was set in a measurement section of the differential scanning calorimeter. An empty aluminum pan was used as a reference. The temperature was increased from 10° C. to 150° C. at a rate of 10° C./minute and was subsequently decreased back to 10° C. at a rate of 10° C./minute. Next, the sample was reheated to 150° C. at a rate of 10° C./minute and a DSC curve was obtained from measurements during the reheating. A temperature corresponding to a maximum of enthalpy of fusion on the DSC curve (heat absorption peak) was determined to be the melting point ($Mp^r$) of the sample.

TABLE 3

| Releasing agent | A | B | C | D | E | F | G | H |
|---|---|---|---|---|---|---|---|---|
| $Mp^r$ [° C.] | 75 | 50 | 85 | 100 | 45 | 110 | 85 | 70 |
| Type | WEP3 | Trial sample | WEP5 | Trial sample | Trial sample | Trial sample | Carnauba wax | Paraffin wax |

Examples 1-21 and Comparative Examples 1-4

Toner Core Preparation

In each of the examples, 100 parts by mass of binder resin, which was an amorphous polyester resin of the type shown in Tables 4-9, 5 parts by mass of colorant (C.I. pigment blue 15:3 (copper phthalocyanine)), and 5 parts by mass of releasing agent of the type shown in Tables 4-9 were mixed using a mixer (FM mixer).

Next, a resulting mixture was melt-kneaded to obtain a kneaded mixture using a twin screw extruder (PCM-30 manufactured by Ikegai Corp.). Cylinder temperature and screw rotation speed of the twin screw extruder during melt-kneading were set according to the conditions shown in Tables 4-9. The kneaded mixture was pulverized using a mechanical pulverizer (Turbo Mill manufactured by FREUND-TURBO CORPORATION). The toners cores were then obtained by classifying a pulverized product using a classifying apparatus (Elbow-Jet manufactured by Nittetsu Mining Co., Ltd.).

A volume median diameter ($D_{50}$) of the toner cores was measured using a Multisizer 3 COULTER COUNTER (manufactured by Beckman Coulter, Inc.). The volume median diameter ($D_{50}$) of the toner cores was 6.0 μm.

Triboelectric charge with a standard carrier and zeta potential in a pH 4 dispersion were measured for the toner cores according to the methods described below. In the case of the toner cores used to prepare the toner in Example 1, the triboelectric charge with the standard carrier was −20 μC/g and the zeta potential in the pH 4 dispersion was −30 mV.

<Method for Measuring Triboelectric Charge with Standard Carrier>

A standard carrier N-01 (standard carrier for use with negative-charging toners) provided by The Imaging Society of Japan and toner cores having a concentration of 7% by mass relative to the standard carrier were mixed for 30 minutes using a tumbler mixer. A resulting mixture was used as a measurement sample. The triboelectric charge of the toner cores when rubbed against the standard carrier was measured using a Q/m meter (Model 210HS-2A manufactured by Trek, Inc.).

<Method for Measuring Zeta Potential in pH 4 Dispersion>

A magnetic stirrer was used to mix 0.2 g of the toner cores, 80 mL of ion exchanged water, and 20 g of a 1% concentration non-ionic surfactant (polyvinylpyrrolidone, K-85 manufactured by Nippon Shokubai Co., Ltd.). A dispersion was obtained in which the toner cores were uniformly dispersed throughout the solvent. Next, a pH 4 dispersion of the toner cores was obtained by adjusting the dispersion to pH 4 through addition of dilute hydrochloric acid. The pH 4 dispersion of the toner cores was used as a measurement sample. The zeta potential of the toner cores in the dispersion was measured using a zeta potential and particle distribution measuring apparatus (DelsaNano HC manufactured by Beckman Coulter, Inc.).

{Shell Layer Formation Process}

First, 300 mL of ion exchanged water was added to a 1 L three-necked flask having a thermometer and a stirring impeller. The internal temperature of the flask was maintained at 30° C. using a water bath. Dilute hydrochloric acid was added to the flask to adjust the pH of the aqueous medium in the flask to 4. After the pH adjustment, methylol melamine aqueous solution (Mirben resin SM-607 manufactured by Showa Denko K.K., solid content concentration of 80% by mass) of an amount shown in Tables 4-8 was added to the flask as a material for the shell layers. The contents of the flask were stirred to dissolve the raw materials for the shell layers in the aqueous medium, thereby acquiring an aqueous solution (A) of the raw materials for the shell layers.

Next, 300 g of the toner cores were added to the aqueous solution (A) and the contents of the flask were stirred at 200 rpm for one hour. After the stiffing, 300 mL of ion exchanged water was added to the flask. Next, the internal temperature of the flask was increased to 70° C. at a rate of 1° C./minute while stirring the contents of the flask at 100 rpm. Once the internal temperature had been increased to 70° C., the contents of the flask were stirred at 100 rpm for a further two hours at the same temperature. Next, the pH of the contents of the flask was adjusted to 7 through addition of sodium hydroxide. After the pH adjustment, a dispersion including toner mother particles was obtained by cooling the contents of the flask to room temperature.

{Washing Process}

A wet cake of the toner mother particles was obtained by filtering the dispersion including the toner mother particles using a Buchner funnel. The toner mother particles were washed by re-dispersing the wet cake of the toner mother particles in ion exchanged water. Washing (i.e., filtration and dispersion) of the toner mother particles using ion exchanged water was repeated five times in the same manner.

{Drying Process}

The wet cake of the toner mother particles was dispersed in an aqueous ethanol solution of a concentration of 50% by mass to obtain a slurry of the toner mother particles. The toner mother particles in the slurry were dried using a continuous type surface modifier (COATMIZER® manufactured by Freund Corporation) to yield the toner mother particles. In terms of drying conditions of the COATMIZER®, the hot-blast temperature was 45° C. and the flow rate was 2 $m^3$/minute.

{External Addition Process}

An external additive (silica) was caused to adhere to the toner mother particles by mixing 100 parts by mass of the toner mother particles obtained from the drying process and 0.5 parts by mass of silica (REA90 manufactured by Nippon Aerosil Co., Ltd.) for five minutes using an FM mixer (manufactured by Nippon Coke & Engineering Co., Ltd.) having a capacity of 10 L. Thereafter, a 200-mesh sieve (opening: 75 μm) was used to sift the toner.

Example 22

In Example 22, the raw material for the shell layers was changed from methylol melamine aqueous solution to 3.0 mL of methylol urea aqueous solution (BECKAMINE® J-300S manufactured by DIC Corporation), but in all other aspects the toner was prepared in the same way as in Example 1.

Examples 23 and 24

In Examples 23 and 24, 85 parts by mass of an amorphous polyester resin of a type shown in Table 9 and 15 parts by mass of a crystalline polyester resin of a type shown in Table 9 were used as the binder resin, but in all other aspects the toner was prepared in the same way as in Example 1.

Example 25

In Example 25, the raw material of the shell layers was changed from the methylol melamine aqueous solution to an glyoxal-containing aqueous solution (Beckamine® NS-11 manufactured by DIC Corporation, solid component concentration 40% by mass, 3.0 mL), but in all other aspects the toner was prepared in the same way as in Example 1.

Example 26

In Example 26, the raw material of the shell layers was changed from the methylol melamine aqueous solution to a mixture (3.0 mL, volume ratio 1:9) of the methylol melamine aqueous solution and a particle dispersion (S-BA) of a styrene-butyl acrylate copolymer, but in all other aspects the toner was prepared in the same way as in Example 1. The aforementioned mixture is explained below.

The following describes preparation of the mixture of the methylol melamine aqueous solution and the particle dispersion (S-BA) of the styrene-butyl acrylate copolymer which was used in Example 26. First, an aqueous solution of an initial polymer of hexamethylol melamine (Mirben resin SM-607 manufactured by Showa Denko K.K., solid component concentration 80% by mass) was used as a material for forming a unit derived from a monomer of a thermosetting resin which is contained in the shell layers. Next, a material for forming a unit derived from a thermoplastic resin which is contained in the shell layers was prepared as explained below. First, 875 mL of ion exchanged water and 75 mL of an anion-based surfactant (sodium polyoxyethylene alkyl ether sulfate, LATEMUL WX manufactured by Kao Corporation) were added to a 1 L three-necked flask having a thermometer and a stirring impeller. Next, the internal temperature of the flask was increased to 80° C. using a water bath. A mixture of 14 mL of styrene and 2 mL of butyl acrylate was dripped into the flask over a period of five hours. Also, 0.5 g of potassium peroxodisulfate was dissolved in 30 mL of ion exchanged water. A solution obtained through the dissolution was also dripped into the flask over the period of five hours at the same time as, but separately to, dripping of the aforementioned mixture. The internal temperature of the flask was maintained at 80° C. for a further two hours, allowing copolymerization to proceed to completion. Through the above, the particle dispersion (S-BA) of the styrene-butyl acrylate copolymer was prepared (solid component concentration 20% by mass). The particles in the particle dispersion (S-BA) thus prepared were determined to have an average particle diameter of 38 nm as observed using a transmission electron microscope. The particle dispersion (S-BA) was used as a material for forming the unit derived from the thermoplastic resin which was included in the shell layers. The aqueous solution of the initial polymer of hexamethylol melamine and the particle dispersion (S-BA) were mixed in a 1:9 volume ratio, thereby preparing the aforementioned mixture of the methylol melamine aqueous solution and the particle dispersion (S-BA) of the styrene-butyl acrylate copolymer.

Comparative Example 5

In Comparative Example 5 the process for forming the shell layers was not performed and thus the toner cores were used as the toner mother particles. The toner was obtained from the toner mother particles in Comparative Example 5 by performing the same external addition process on the toner mother particles as in Example 1.

<<Toner Glass Transition Point ($Tg^t$) and Softening Point ($Tm^t$)>>

The glass transition point ($Tg^t$) of the toner in each of Examples 1-26 and Comparative Examples 1-5 was measured using a differential scanning calorimeter. The softening point ($Tm^t$) of the toner was measured using an elevated flow tester (capillary rheometer). The glass transition points ($Tg^t$) and the softening points ($Tm^t$) of the toners in Examples 1-26 and Comparative Examples 1-5 are shown in Tables 4-10.

<<Shell Layer Thickness>>

TEM images of cross-sections of toner particles included in the toner in each of Examples 1-26 and Comparative Examples 1-4 were captured according to the following method. Note that measurement of shell layer thickness was not performed for toner particles included in the toner of Comparative Example 5 due to the toner particles not including shell layers. Shell layer thickness was measured from the cross-sectional TEM images of the toner particles according to the method described below. The shell layer thicknesses of the toner particles included in the toners in Examples 1-26 and Comparative Examples 1-4 are shown in Tables 4-10.

<Method for Capturing Cross-Sectional TEM Images of Toner Particles>

First, the toner was dispersed in a cold-setting epoxy resin and left to stand for two days at an ambient temperature of 40° C. to obtain a hardened material. The hardened material thus obtained was dyed with osmium tetroxide. A slice sample of thickness 200 nm for cross-sectional observation of the toner particles was cut from the resulting hardened dyed material using a microtome (EM UC6 manufactured by Leica Microsystems). The resulting slice sample was observed using a transmission electron microscope (TEM, JSM-6700F manufactured by JEOL Ltd.) at magnifications of ×3000 and ×10,000, and cross-sectional TEM images of the toner particles were captured.

<Method for Measuring Shell Layer Thickness>

The shell layer thickness was measured from the cross-sectional TEM images captured of the toner particles by analyzing the TEM images using image-analyzing software (WinROOF provided by Mitani Corporation). More specifically, on the cross-section of a toner particle, two straight lines were drawn to intersect at right angles at approximately the center of the cross-section. Lengths of segments of the two lines crossing the shell layer were measured at four locations. An average value of the lengths measured at the four locations was determined to be an evaluation value of the toner particle (i.e., thickness of the shell layer of the one toner particle that was the measurement target). Shell layer thickness was measured according to the same method for ten toner particles included in the toner. An average value of the shell layer thicknesses measured for the ten toner particles (i.e., the evaluation values of the ten toner particles) was determined to be an evaluation value of the toner (i.e., shell layer thickness of the toner which was measured).

<<Number Average Dispersion Diameter of Releasing Agent>>

With respect to the toner in each of Examples 1-26 and Comparative Examples 1-5, a slice sample of thickness 150 nm for cross-section observation of the toner particles was cut in the same way as in the method described above for capturing cross-sectional TEM images of toner particles. The resulting slice sample was observed using a transmission electron microscope (TEM, JSM-7600F manufactured by JEOL Ltd.) at a magnification of ×3000, and cross-sectional TEM images of the toner particles were captured. The number average dispersion diameter of the releasing agent was measured from the cross-sectional TEM images of the toner particles according to the method described below. The number average dispersion diameter of the releasing agent, measured from the cross-sectional TEM images of the toner particles, is shown in Tables 4-10 for the toners in Examples 1-26 and Comparative Examples 1-5.

<Method for Measuring Number Average Dispersion Diameter of Releasing Agent>

The number average dispersion diameter of the releasing agent was measured from the cross-sectional TEM images of the toner particles by analyzing the TEM images using image-analyzing software (WinROOF provided by Mitani Corporation). More specifically, the particle diameter of ten releasing agent particles included in a toner particle depicted in a TEM image was measured and an average value of the measured particle diameters was determined to be a dispersion diameter of the releasing agent included in the toner particle. The measurement of the dispersion diameter of the releasing agent described above was performed with respect to an arbitrary sample of 30 toner particles. Thus, a plurality of releasing agent dispersion diameters were measured, each of which was measured for releasing agent contained in a corresponding toner particle among the toner particles that were measurement targets. An average value of the aforementioned releasing agent dispersion diameters was calculated and determined to be the number average dispersion diameter of the releasing agent.

<<Evaluation 1>>

The high-temperature preservability of the toner in each of Examples 1-26 and Comparative Examples 1-5 was evaluated according to the method described below. Evaluation results of the high-temperature preservabilities of the toners in Examples 1-26 and Comparative Examples 1-5 are shown in Tables 4-10.

<Evaluation of High-Temperature Preservability>

First, 2 g of the toner was weighed into a 20 mL plastic container and was left to stand for three hours in a thermostatic chamber set to 60° C., thereby obtaining a toner for high-temperature preservability evaluation. Next, the toner for high-temperature preservability evaluation was sifted using a 200-mesh sieve (opening: 75 nm) for 30 seconds at a rheostat level of 5 in accordance with a manual for a Powder Tester (manufactured by Hosokawa Micron Corporation). After the sifting, the mass of the toner remaining in the sieve was measured. The aggregation degree of the toner was calculated, in accordance with the expression shown below, from the mass of the toner prior to the sifting and the mass of the toner remaining in the sieve after the sifting. The aggregation degree was evaluated in accordance with the following criterion. An evaluation result of "Good" was determined to be an evaluation pass.

Aggregation degree (% by mass)=Mass of toner remaining in sieve/Mass of toner prior to sifting×100 (Expression for Calculating Aggregation Degree)

Good: Aggregation degree of no greater than 30% by mass

Poor: Aggregation degree exceeding 30% by mass

<<Evaluation 2>>

Low-temperature fixability, high-temperature offset resistance, and glossiness of a formed image were evaluated for the toner in each of Examples 1-26 and Comparative Examples 1-5 according to the following methods. The low-temperature fixability, the high-temperature offset resistance, and the glossiness of the formed image were evaluated for each of the toners using a two-component developer prepared according to the method described below. Evaluation results of the low-temperature fixabilities, the high-temperature offset resistances, and the glossinesses of the formed images are shown in Tables 4-10 for the toners in Examples 1-26 and Comparative Examples 1-5.

Preparation Example 3

{Two-Component Developer Preparation}

The two-component developer was prepared by mixing a developer carrier (TASKalfa 5550 carrier manufactured by KYOCERA Document Solutions Inc.) and 10% by mass of the toner relative to mass of the carrier for 30 minutes using a ball mill.

<Evaluation of Low-Temperature Fixability>

A printer modified to enable fixing temperature adjustment (modified version of FS-05250DN manufactured by KYOCERA Document Solutions Inc.) was used as an evaluation apparatus. The two-component developer prepared according to Preparation Example 3 was added into a development section for cyan in the evaluation apparatus and a sample (toner) was added into a toner container for cyan in the evaluation apparatus. A solid image was formed in an unfixed state on a recording medium with the evaluation apparatus set to a linear velocity of 200 mm/s and a toner application amount of 1.0 mg/cm$^2$. The solid image was fixed in a temperature range from no less than 100° C. to no greater than 200° C. by raising the fixing temperature of a fixing device in the evaluation apparatus in 1° C. increments from 100° C. The recording medium with the solid image fixed thereon was folded in half such that a surface with the solid image thereon was folded inwards. A 1 kg weight covered by cloth was rubbed back and forth five times on the fold. Next, the recording medium was opened out and a fold portion of the fixed image was observed. A case in which peeling of the toner on the fold portion was no greater than 1 mm was determined to be an evaluation pass and a case in which the peeling of the toner exceeded 1 mm was determined to be an evaluation fail. The lowest fixing temperature at which peeling of the toner was determined to be an evaluation pass was determined to be a minimum fixing temperature. The low-temperature fixability of the toner was evaluated according to the following criterion.

Good: Minimum fixing temperature of no greater than 160° C.

Poor: Minimum fixing temperature exceeding 160° C.

<Evaluation of High-Temperature Offset Resistance>

An solid image was formed in an unfixed state on a recording medium under the same conditions, and using the same evaluation apparatus and recording medium as in the evaluation of the low-temperature fixability. The solid image was fixed in a temperature range from no less than 120° C. to no greater than 210° C. by raising the fixing temperature of the fixing device in the evaluation apparatus in 1° C. increments from 120° C. The lowest temperature at which offset occurred was determined to be a minimum offset occurrence temperature. The high-temperature offset resistance of the toner was evaluated according to the following criterion.

Good: Minimum offset occurrence temperature of at least 200° C.

Poor: Minimum offset occurrence temperature lower than 200° C.

<Evaluation of Glossiness of Formed Image>

A page printer manufactured by KYOCERA Document Solutions Inc. (FS-05300DN, linear velocity 170 mm/s) was used as an evaluation apparatus. The two-component developer prepared according to Preparation Example 3 was added into a development section for cyan in the evaluation apparatus and a sample (toner) was added into a toner container for cyan in the evaluation apparatus. The evaluation apparatus was used to form a 30 mm×30 mm solid image (toner application amount: 0.5 mg/cm$^2$) on a recording sheet (C2 paper manufactured by Fuji Xerox Co., Ltd., 70 g/m$^2$) under standard ambient temperature and humidity conditions (20° C. and 65% RH). The glossiness (glossiness value) of the solid image was measured using a gloss meter (IG-331 Gloss Checker manufactured by HORIBA, Ltd., measurement angle 60°). The glossiness of the formed image was evaluated from the measured glossiness value according to the following criterion.

Good: Glossiness value of at least 10

Poor: Glossiness value of less than 10

TABLE 4

| Example | 1 | 2 | 3 | 4 | 5 | 6 |
|---|---|---|---|---|---|---|
| Amorphous polyester resin | | | | | | |
| Type | A | A | A | A | A | A |
| Releasing agent | | | | | | |
| Type | A | B | C | D | G | H |
| Melt-kneading conditions | | | | | | |
| Cylinder temperature [° C.] | 85 | 75 | 95 | 105 | 95 | 85 |
| Screw rotation speed [rpm] | 160 | 160 | 160 | 160 | 160 | 160 |
| Addition amount of methylol melamine aqueous solution [mL] | 3.0 | 3.0 | 3.0 | 3.0 | 3.0 | 3.0 |
| Tg$^f$ [° C.] | 38 | 30 | 38 | 41 | 40 | 34 |
| Tm$^f$ [° C.] | 88 | 76 | 89 | 91 | 90 | 85 |
| Shell layer thickness [μm] | 9 | 9 | 9 | 9 | 9 | 9 |
| Number average dispersion diameter of releasing agent [nm] | 250 | 250 | 250 | 250 | 250 | 250 |
| Evaluation 1 | | | | | | |
| High-temperature preservability | | | | | | |
| Aggregation degree [% by mass] | 6 | 21 | 7 | 7 | 7 | 9 |
| Evaluation result | Good | Good | Good | Good | Good | Good |
| Evaluation 2 | | | | | | |
| Low-temperature fixability | | | | | | |
| Minimum fixing temperature [° C.] | 147 | 133 | 150 | 153 | 151 | 145 |
| Evaluation result | Good | Good | Good | Good | Good | Good |
| High-temperature offset | | | | | | |
| Minimum offset occurrence temperature [° C.] | 213 | 209 | 210 | 215 | 212 | 207 |
| Evaluation result | Good | Good | Good | Good | Good | Good |
| Glossiness | | | | | | |
| Glossiness value | 16 | 18 | 14 | 12 | 14 | 17 |
| Evaluation result | Good | Good | Good | Good | Good | Good |

TABLE 5

| Example | 7 | 8 | 9 | 10 | 11 |
|---|---|---|---|---|---|
| Amorphous polyester resin | | | | | |
| Type | A | A | A | A | A |
| Releasing agent | | | | | |
| Type | A | A | A | A | A |
| Melt-kneading conditions | | | | | |
| Cylinder temperature [° C.] | 65 | 105 | 125 | 125 | 135 |
| Screw rotation speed [rpm] | 160 | 160 | 160 | 140 | 120 |
| Addition amount of methylol melamine aqueous solution [mL] | 3.0 | 3.0 | 3.0 | 3.0 | 3.0 |

TABLE 5-continued

| Example | 7 | 8 | 9 | 10 | 11 |
|---|---|---|---|---|---|
| Tg$^f$ [° C.] | 38 | 38 | 38 | 38 | 38 |
| Tm$^f$ [° C.] | 90 | 88 | 88 | 88 | 87 |
| Shell layer thickness [μm] | 9 | 9 | 9 | 9 | 9 |
| Number average dispersion diameter of releasing agent [nm] | 30 | 100 | 200 | 300 | 500 |
| Evaluation 1 | | | | | |
| High-temperature preservability | | | | | |
| Aggregation degree [% by mass] | 3 | 5 | 6 | 8 | 10 |
| Evaluation result | Good | Good | Good | Good | Good |
| Evaluation 2 | | | | | |
| Low-temperature fixability | | | | | |
| Minimum fixing temperature [° C.] | 146 | 146 | 147 | 148 | 148 |
| Evaluation result | Good | Good | Good | Good | Good |
| High-temperature offset | | | | | |
| Minimum offset occurrence temperature [° C.] | 208 | 208 | 216 | 220 | 220 |
| Evaluation result | Good | Good | Good | Good | Good |
| Glossiness | | | | | |
| Glossiness value | 14 | 14 | 16 | 17 | 17 |
| Evaluation result | Good | Good | Good | Good | Good |

TABLE 6

| Comparative example | 1 | 2 | 3 | 4 |
|---|---|---|---|---|
| Amorphous polyester resin | | | | |
| Type | A | A | A | A |
| Releasing agent | | | | |
| Type | E | F | A | A |
| Melt-kneading conditions | | | | |
| Cylinder temperature [° C.] | 85 | 85 | 65 | 135 |
| Screw rotation speed [rpm] | 160 | 160 | 180 | 100 |
| Addition amount of methylol melamine aqueous solution [mL] | 3.0 | 3.0 | 3.0 | 3.0 |
| Tg$^f$ [° C.] | 25 | 58 | 33 | 45 |
| Tm$^f$ [° C.] | 70 | 110 | 76 | 86 |
| Shell layer thickness [μm] | 9 | 9 | 9 | 9 |
| Number average dispersion diameter of releasing agent [nm] | 260 | 260 | 20 | 600 |
| Evaluation 1 | | | | |
| High-temperature preservability | | | | |
| Aggregation degree [% by mass] | 22 | 1 | 4 | 17 |
| Evaluation result | Good | Good | Good | Good |
| Evaluation 2 | | | | |
| Low-temperature fixability | | | | |
| Minimum fixing temperature [° C.] | 160 | 195 | 152 | 164 |
| Evaluation result | Good | Poor | Good | Poor |
| High-temperature offset | | | | |
| Minimum offset occurrence temperature [° C.] | 195 | 240 | 195 | 218 |
| Evaluation result | Poor | Good | Poor | Good |
| Glossiness | | | | |
| Glossiness value | 9 | 5 | 5 | 8 |
| Evaluation result | Poor | Poor | Poor | Poor |

TABLE 7

| Example | 12 | 13 | 14 | 15 | 16 |
|---|---|---|---|---|---|
| Amorphous polyester resin | | | | | |
| Type | A | A | A | A | A |
| Releasing agent | | | | | |
| Type | A | A | A | A | A |
| Melt-kneading conditions | | | | | |
| Cylinder temperature [° C.] | 85 | 85 | 85 | 85 | 85 |
| Screw rotation speed [rpm] | 160 | 160 | 160 | 160 | 160 |
| Addition amount of methylol melamine aqueous solution [mL] | 0.7 | 1.0 | 2.0 | 4.0 | 6.3 |
| $Tg^f$ [° C.] | 38 | 38 | 38 | 38 | 38 |
| $Tm^f$ [° C.] | 88 | 88 | 88 | 88 | 88 |
| Shell layer thickness [μm] | 2 | 3 | 6 | 12 | 19 |
| Number average dispersion diameter of releasing agent [nm] | 250 | 250 | 250 | 250 | 250 |
| Evaluation 1 | | | | | |
| High-temperature preservability | | | | | |
| Aggregation degree [% by mass] | 29 | 21 | 11 | 5 | 2 |
| Evaluation result | Good | Good | Good | Good | Good |
| Evaluation 2 | | | | | |
| Low-temperature fixability | | | | | |
| Minimum fixing temperature [° C.] | 135 | 138 | 144 | 154 | 159 |
| Evaluation result | Good | Good | Good | Good | Good |
| High-temperature offset | | | | | |
| Minimum offset occurrence temperature [° C.] | 210 | 213 | 214 | 218 | 220 |
| Evaluation result | Good | Good | Good | Good | Good |
| Glossiness | | | | | |
| Glossiness value | 18 | 17 | 17 | 14 | 12 |
| Evaluation result | Good | Good | Good | Good | Good |

TABLE 8

| Example | 17 | 18 | 19 | 20 |
|---|---|---|---|---|
| Amorphous polyester resin | | | | |
| Type | C | D | E | F |
| Releasing agent | | | | |
| Type | A | A | A | A |
| Melt-kneading conditions | | | | |
| Cylinder temperature [° C.] | 85 | 85 | 85 | 85 |
| Screw rotation speed [rpm] | 160 | 160 | 160 | 160 |
| Addition amount of methylol melamine aqueous solution [mL] | 3.0 | 3.0 | 3.0 | 3.0 |
| $Tg^f$ [° C.] | 25 | 55 | 30 | 48 |
| $Tm^f$ [° C.] | 70 | 98 | 73 | 90 |
| Shell layer thickness [μm] | 9 | 9 | 9 | 9 |
| Number average dispersion diameter of releasing agent [nm] | 250 | 250 | 250 | 250 |
| Evaluation 1 | | | | |
| High-temperature preservability | | | | |
| Aggregation degree [% by mass] | 7 | 1 | 5 | 8 |
| Evaluation result | Good | Good | Good | Good |
| Evaluation 2 | | | | |
| Low-temperature fixability | | | | |
| Minimum fixing temperature [° C.] | 146 | 158 | 149 | 153 |
| Evaluation result | Good | Good | Good | Good |
| High-temperature offset | | | | |
| Minimum offset occurrence temperature [° C.] | 205 | 238 | 209 | 222 |
| Evaluation result | Good | Good | Good | Good |
| Glossiness | | | | |
| Glossiness value | 15 | 12 | 14 | 13 |
| Evaluation result | Good | Good | Good | Good |

TABLE 9

| | Example 21 | Example 22 | Example 23 | Example 24 | Comparative example 5 |
|---|---|---|---|---|---|
| Amorphous polyester resin | | | | | |
| Type | B | A | A | A | A |
| Crystalline polyester resin | | | | | |
| Type | — | — | A | B | — |
| Melting point $Mp^c$ [° C.] | — | — | 50 | 100 | — |
| Releasing agent | | | | | |
| Type | A | A | A | A | A |
| Melt-kneading conditions | | | | | |
| Cylinder temperature [° C.] | 85 | 85 | 85 | 85 | 85 |
| Screw rotation speed [rpm] | 160 | 160 | 160 | 160 | 160 |
| Shell layer material | | | | | |
| Type | Methylol melamine aqueous solution | Methylol urea aqueous solution | Methylol melamine aqueous solution | Methylol melamine aqueous solution | — |
| Addition amount [mL] | 3.0 | 3.0 | 3.0 | 3.0 | — |
| $Tg^f$ [° C.] | 36 | 38 | 27 | 33 | 38 |
| $Tm^f$ [° C.] | 85 | 88 | 71 | 80 | 88 |
| Shell layer thickness [μm] | 7 | 9 | 9 | 9 | — |

TABLE 9-continued

| | Example 21 | Example 22 | Example 23 | Example 24 | Comparative example 5 |
|---|---|---|---|---|---|
| Number average dispersion diameter of releasing agent [nm] | 250 | 250 | 250 | 250 | 250 |
| Evaluation 1 High-temperature preservability | | | | | |
| Aggregation degree [% by mass] | 10 | 10 | 28 | 10 | 98 |
| Evaluation result | Good | Good | Good | Good | Poor |
| Evaluation 2 Low-temperature fixability | | | | | |
| Minimum fixing temperature [° C.] | 143 | 148 | 130 | 148 | 133 |
| Evaluation result | Good | Good | Good | Good | Good |
| High-temperature offset | | | | | |
| Minimum offset occurrence temperature [° C.] | 212 | 219 | 202 | 210 | 210 |
| Evaluation result | Good | Good | Good | Good | Good |
| Glossiness | | | | | |
| Glossiness value | 17 | 17 | 18 | 17 | 17 |
| Evaluation result | Good | Good | Good | Good | Good |

TABLE 10

| | Example 25 | Example 26 |
|---|---|---|
| Amorphous polyester resin | | |
| Type | A | A |
| Crystalline polyester resin | | |
| Type | — | — |
| Melting point $Mp^c$ [° C.] | — | — |
| Releasing agent | | |
| Type | A | A |
| Melt-kneading conditions | | |
| Cylinder temperature [° C.] | 85 | 85 |
| Screw rotation speed [rpm] | 160 | 160 |
| Shell layer material | | |
| Type | Glyoxal-containing aqueous solution | Methylol melamine aqueous solution/ particle dispersion (S-BA) (volume ratio 1:9) |
| Addition amount [mL] | 3.0 | 3.0 |
| $Tg^r$ [° C.] | 38 | 38 |
| $Tm^r$ [° C.] | 88 | 88 |
| Shell layer thickness [μm] | 9 | 9 |
| Number average dispersion diameter of releasing agent [nm] | 250 | 250 |
| Evaluation 1 High-temperature preservability | | |
| Aggregation degree [% by mass] | 5 | 3 |
| Evaluation result | Good | Good |
| Evaluation 2 Low-temperature fixability | | |
| Minimum fixing temperature [° C.] | 145 | 150 |
| Evaluation result | Good | Good |
| High-temperature offset | | |
| Minimum offset occurrence temperature [° C.] | 211 | 217 |
| Evaluation result | Good | Good |

TABLE 10-continued

| | Example 25 | Example 26 |
|---|---|---|
| Glossiness | | |
| Glossiness value | 16 | 15 |
| Evaluation result | Good | Good |

Based on Examples 1-26, it can be determined that a toner has excellent high-temperature preservability and low-temperature fixability, can restrict occurrence of offset during fixing at high temperatures, and can form an image having desired glossiness when:

the toner includes toner particles, each including a toner core containing a binder resin and a releasing agent, and a shell layer coating the toner core;

the releasing agent has a melting point ($Mp^r$) of no less than 50° C. and no greater than 100° C.;

the releasing agent has a number average dispersion diameter of no less than 30 nm and no greater than 500 nm;

the shell layer is made from a resin including a unit derived from a monomer of a thermosetting resin; and the thermosetting resin is one or more resins selected from the group of amino resins consisting of a melamine resin, a urea resin, and a glyoxal resin.

In Comparative Example 1, the toner cores used to prepare the toner particles of the toner contained a releasing agent having an excessively low melting point ($Mp^r$). The evaluations illustrate that a toner such as in Comparative Example 1 may not effectively restrict occurrence of offset during fixing at high temperatures and may not effectively form an image having desired glossiness. In Comparative Example 2, the toner cores used to prepare the toner particles of the toner contained a releasing agent having an excessively high melting point ($Mp^r$). The evaluations illustrate that a toner such as in Comparative Example 2 has poor low-temperature fixability and may not effectively form an image having desired glossiness.

In Comparative Example 3, the toner cores used to prepare the toner particles of the toner contained a releasing agent having an excessively low number average dispersion diameter. The evaluations illustrate that a toner such as in Comparative Example 3 may not effectively restrict occurrence of offset during fixing at high temperatures and may not effectively form an image having desired glossiness. In Comparative Example 4, the toner cores used to prepare the toner particles of the toner contained a releasing agent having an excessively high number average dispersion diameter. The evaluations illustrate that a toner such as in Comparative Example 4 has poor low-temperature fixability and may not effectively form an image having desired glossiness.

In Comparative Example 5, the toner particles of the toner did not include shell layers. The evaluations illustrate that a toner such as in Comparative Example 5 has poor high-temperature preservability. In Comparative Example 5, components contained in the toner cores such as the releasing agent can readily exude to the surface of the toner particles of the toner. The above is considered to cause the poor high-temperature preservability of the toner in Comparative Example 5.

The electrostatic latent image developing toner according to the present disclosure has excellent high-temperature preservability and low-temperature fixability, can restrict occurrence of offset during fixing at high temperatures, and can form an image having desired glossiness.

What is claimed is:

1. An electrostatic latent image developing toner comprising toner particles, each including:

a toner core containing a binder resin and a releasing agent; and a shell layer coating the toner core, wherein the releasing agent has a melting point $Mp^r$ of no less than 50° C. and no greater than 100° C., the releasing agent has a number average dispersion diameter of no less than 30 nm and no greater than 500 nm, the shell layer is made from a resin including a unit derived from a monomer of a thermosetting resin, the thermosetting resin is one or more resins selected from the group of amino resins consisting of a melamine resin, a urea resin, and a glyoxal resin, and the shell layer has a thickness of not less than 1 nm and no greater than 20 nm.

2. An electrostatic latent image developing toner according to claim 1, wherein the melting point $Mp^r$ of the releasing agent is a melting point as measured by a differential scanning calorimeter, and the number average dispersion diameter of the releasing agent is a number average dispersion diameter as measured from a cross-sectional image of the toner particle captured by a transmission electron microscope at ×3000 magnification.

3. An electrostatic latent image developing toner according to claim 1, wherein the resin from which the shell layer is made further includes a unit derived from a monomer of a thermosetting resin and a unit derived from a thermoplastic resin.

4. An electrostatic latent image developing toner according to claim 1, wherein the releasing agent is made from a synthetic ester wax.

5. An electrostatic latent image developing toner according to claim 1, wherein the binder resin is made from a polyester resin, the polyester resin has a mass average molecular weight Mw of no less than 10,000 and no greater than 50,000, and the polyester resin has a molecular weight distribution Mw/Mn, expressed as a ratio of the mass average molecular weight Mw relative to a number average molecular weight Mn of the polyester resin, of no less than 8 and no greater than 50.

6. An electrostatic latent image developing toner according to claim 5, wherein the polyester resin has an acid value of no less than 5 mg KOH/g and no greater than 30 mg KOH/g, and the polyester resin has a hydroxyl value of no less than 15 mg KOH/g and no greater than 80 mg KOH/g.

7. An electrostatic latent image developing toner according to claim 6, wherein the polyester resin contains crystalline polyester resin, and the crystalline polyester resin has a melting point $Mp^c$ of no less than 50° C. and no greater than 100° C. as measured by a differential scanning calorimeter.

8. An electrostatic latent image developing toner according to claim 1, wherein the electrostatic latent image developing toner has a glass transition point $Tg^t$ of no less than 35° C. and no greater than 50° C., and the electrostatic latent image developing toner has a softening point $Tm^t$ of no less than 70° C. and no greater than 100° C. as measured by an elevated flow tester.

9. An electrostatic latent image developing toner according to claim 1, wherein the shell layer has a thickness of no less than 1 nm and no greater than 10 nm.

10. An electrostatic latent image developing toner according to claim 1, wherein in the resin from which the shell layer is made, the unit derived from the monomer of the thermosetting resin has a content of 100% by mass.

11. An electrostatic latent image developing toner according to claim 1, wherein the toner core has a negative zeta potential as measured in an aqueous medium adjusted to pH 4, the toner core has a negative triboelectric charge, and the shell later contains no dispersant.

* * * * *